US008132278B1

(12) United States Patent
Bailey

(10) Patent No.: US 8,132,278 B1
(45) Date of Patent: Mar. 13, 2012

(54) STERILE OPERATING TABLE EXTENSION

(75) Inventor: James Bailey, Old Saybrook, CT (US)

(73) Assignee: iMP Inc., Plainville, CT (US)

( * ) Notice: Subject to any disclaimer, the term of this patent is extended or adjusted under 35 U.S.C. 154(b) by 156 days.

(21) Appl. No.: 12/655,571

(22) Filed: Jan. 4, 2010

(51) Int. Cl.
*A61G 13/12* (2006.01)
*A61G 7/075* (2006.01)

(52) U.S. Cl. ..... 5/648; 5/624; 5/651; 128/882

(58) Field of Classification Search ..... 5/621, 624, 5/648–651, 507.1, 623, 646; 128/845, 882
See application file for complete search history.

(56) References Cited

U.S. PATENT DOCUMENTS

| | | | | | |
|---|---|---|---|---|---|
| 3,289,674 | A * | 12/1966 | Platt | 602/39 |
| 3,766,384 | A * | 10/1973 | Anderson | 378/209 |
| 4,045,011 | A * | 8/1977 | Ford | 5/646 |
| 4,913,413 | A * | 4/1990 | Raab | 5/624 |
| 5,056,535 | A * | 10/1991 | Bonnell | 128/882 |
| 5,287,575 | A * | 2/1994 | Allen et al. | 5/623 |
| 5,462,551 | A * | 10/1995 | Bailey et al. | 606/88 |
| 6,003,176 | A * | 12/1999 | Wasley et al. | 5/624 |
| 6,195,820 | B1 * | 3/2001 | Heimbrock et al. | 5/623 |
| 6,820,621 | B2 * | 11/2004 | DeMayo | 128/845 |
| 7,003,827 | B2 * | 2/2006 | DeMayo | 5/600 |

* cited by examiner

*Primary Examiner* — Michael Trettel

(57) ABSTRACT

A flat table extension is removably attached to one end of an operating table via a support mechanism that is connected with one of the operating table support legs.
The support mechanism includes a pair of support posts, one of which is rotated from a first position parallel with the operating table to a second position lower than the operating table to lower the table extension as required.

11 Claims, 3 Drawing Sheets

STERILE OPERATING TABLE EXTENSION

BACKGROUND OF THE INVENTION

Methods are currently available for providing an extension to operating tables for adding surgical support devices and the like.

One such portable table assembly is described within U.S. Pat. No. 5,758,374 entitled "Portable Table Assembly", which is positioned at one end of the operating table outside the operating table sterile field.

When a knee positioner device, as described within U.S. Pat. No. 6,003,176, is required to be used in knee replacement surgery, for example, the device must be sterilized for placement within the operating table sterile field.

It would be of great convenience if the positioner device could be positioned on an operating table extension device at an end of the operating table thereby extending the operating sterile field.

One purpose of the instant invention is to provide such an operating table extension at one end of the operating table within the operating table sterile field.

SUMMARY OF THE INVENTION

A flat table extension is removably attached to one end of an operating table via a support mechanism that is connected over one of the operating table support legs and over a sterile drape.

The support mechanism includes a first support post that includes a semicircular extension defining a plurality of apertures. The first support post is fastened to the operating table side rail within the operating table sterile field and connects with a first table bar that extends beneath the table extension. A second support post connects with the mid section of the table extension at one end and with a second table bar that extends beneath the table extension at an opposite end thereof. The table extension can be rotated from a first position parallel with the operating table to a second position lower than the operating table by moving the opposite end of the second support post along the extension apertures in descending order.

DESCRIPTION OF THE PREFERRED EMBODIMENT

Figure 1:
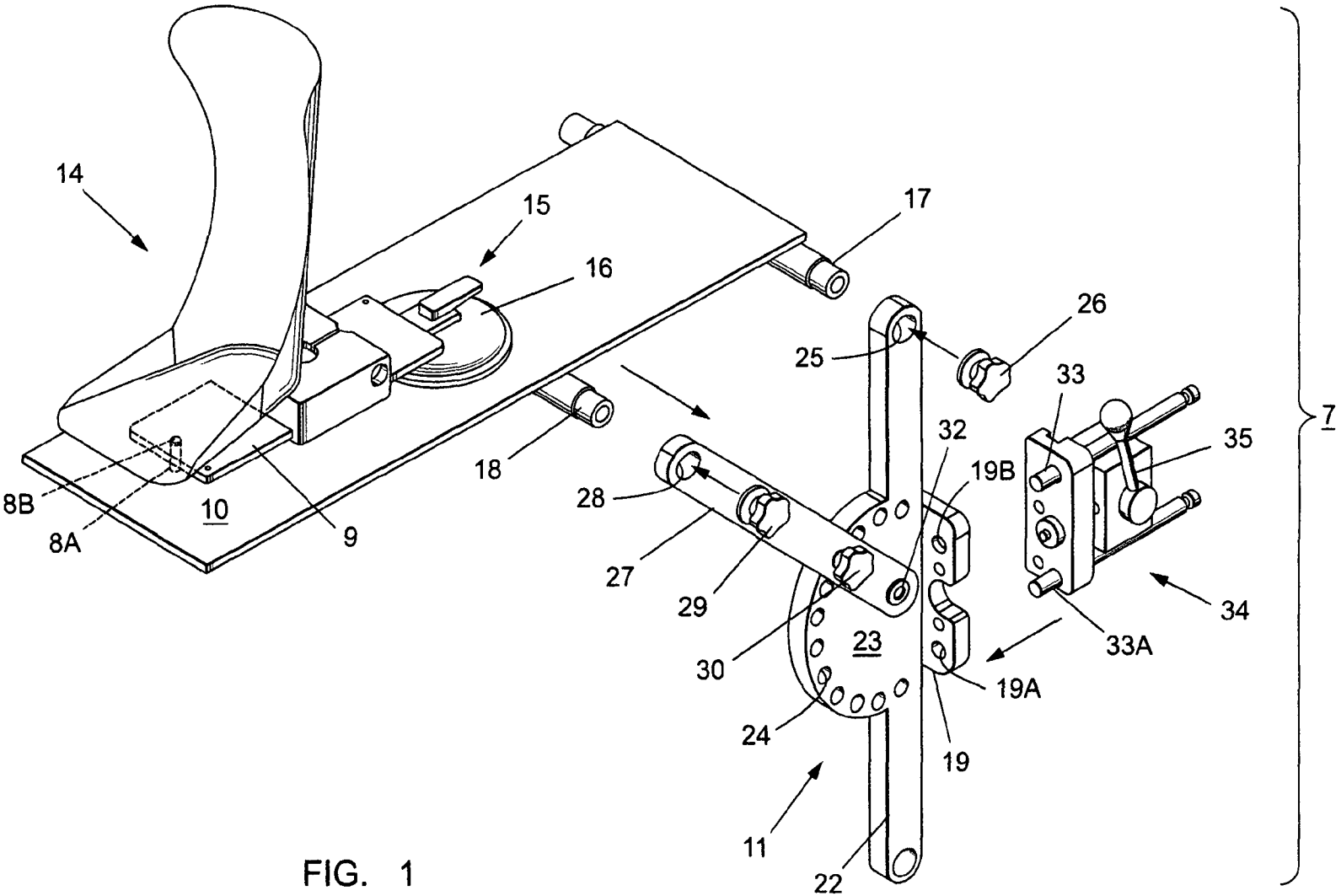
FIG. 1 depicts the table extension assembly components according to the invention prior to complete assembly.

As shown in FIG. 1, the complete assembly 7 of the table extension according to the invention includes the table extension 10 attached to a support plate 9 via bolts 8A, 8B at a front thereof and via the vacuum attachment device 15 including the vacuum cup 16, at the rear. The vacuum attachment device is similar to that described within U.S. patent application Ser. No. 12/002,355 entitled "Method and Apparatus for Attaching Surgical Support Equipment to an Operating Table", which application is incorporated herein for purposes of reference. Attached to the top of the support plate 9 is knee positioner 14 such as that described in U.S. Pat. No. 5,462, 551 entitled "Knee Positioner" for assisting a surgeon during knee replacement surgery, for example.

Although a knee positioner is described herein, other limb support devices such as a hip support device as described within U.S. Pat. No. 6,820,621 entitled "Lateral Surgical Positioner Unit" can also be employed.

The table extension support mechanism 11 is an important feature of the invention for purposes to be described below in greater detail, and includes a first support arm 22 to which is attached a second support arm 27. The support arm 22 includes a semicircular extension 23 having a plurality of peripheral openings 24 to which the second support arm 27 is removably attached via a pair of connectors 30, 32 as indicated.

The table extension 10 includes a pair of elongated threaded support bars 17, 18 which extend along the undersurface thereof and are received within the openings 25, 28 at the ends of the support arms 22, 27 for fastening the table extension to the support arms via knurled connectors 26, 29. To allow the table extension 10 to rotate relative to the support arm 22, first support bar 17 is fixedly attached to one end of the table extension to allow the table extension to rotate when the second support bar 18 is arranged for movement along a bottom surface of the table extension.

A connector plate 19 is welded to the support arm 22 and includes a pair of openings 19A, 19B for receiving the posts 33, 33A extending from a single lever clamp 34, such as that described within U.S. Pat. No. 7,003,827 entitled "Operating Table Support Clamp", in press-fit relation, as depicted in FIG. 2, prior to attachment to an operating table support leg 13, also shown in FIG. 2, via operating lever 35 in the manner to be described with reference now to both FIGS. 2 and 3.

Figure 2:
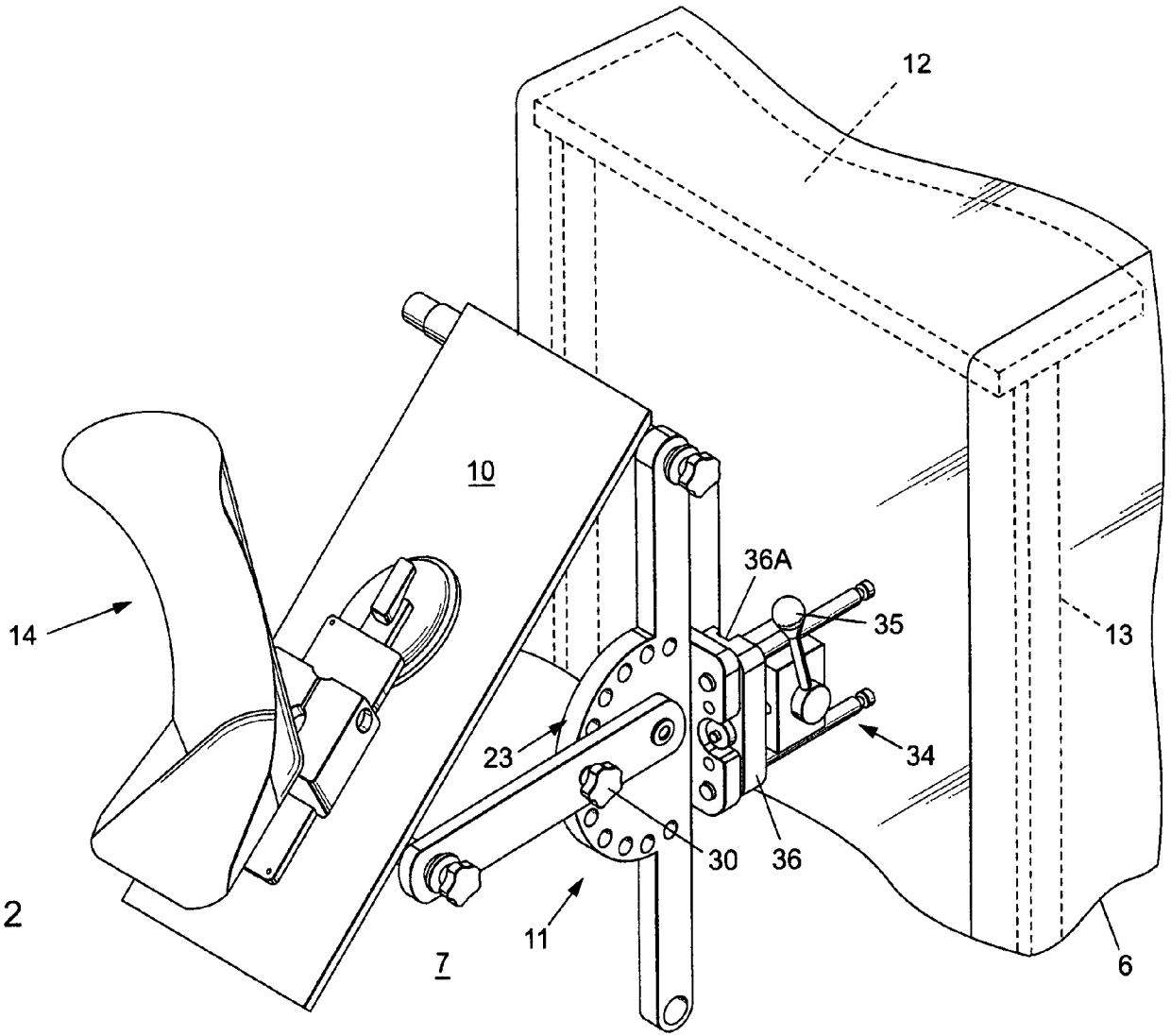
FIG. 2 depicts complete assembly of the table extension of FIG. 1 prior to attachment to an operating table within a sterile field.

The arrangement of the complete assembly 7 including the sterilized hip positioner 14, sterilized table extension 10 and the sterilized table extension support mechanism 11 is shown in FIG. 2 prior to attachment to one of the support legs 13 of the operating table 12.

The provision of the sterile drape 6 over the operating table 12 and operating table support legs 13 thereby creates a sterile field by preventing contact with the unsterilized operating table 12 and unsterilized operating table support legs 13. The attachment of the sterilized table extension 10 to the operating table 12 is accomplished by capturing one of the support legs 13 within the extended slot 36A formed on the plate 36 on the front of the single lever clamp 34 and fastening the same thereto by means of the operating lever 35, as shown in FIG. 3.

Figure 3:
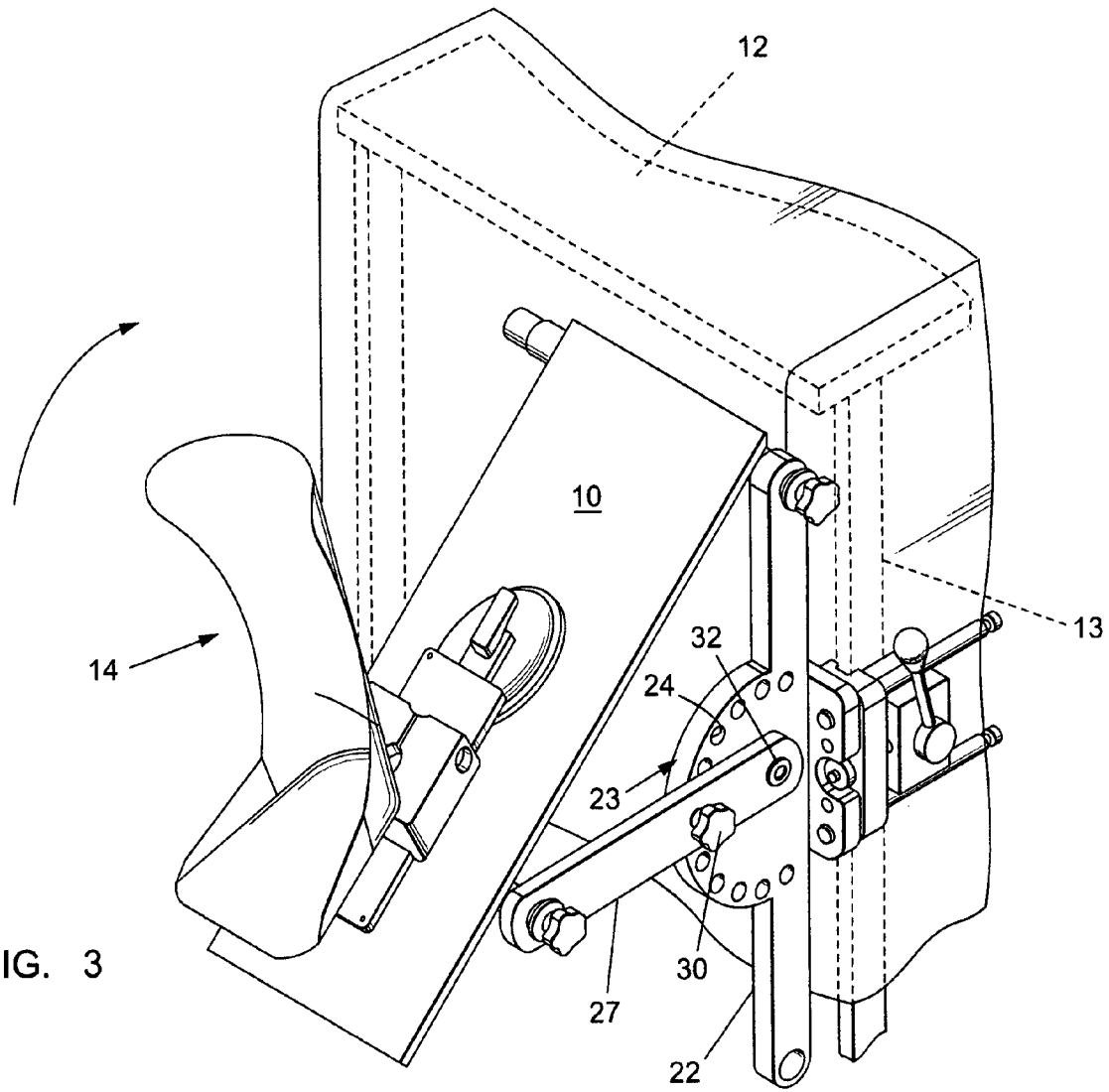
FIG. 3 depicts complete assembly of the table extension of FIG. 1 attached to an operating table within the sterile field.

To rotate the hip positioner 14 and table extension 10 in the clockwise direction as indicated in FIG. 3, the knurled connector 30 on the table extension support mechanism 11 is removed from the one of the openings 24 within the semicircular extension 23 thereby allowing the hip positioner 14 and table extension 10 to rotate into a preferred position.

To maintain the hip positioner 14 and table extension 10 at the preferred position the knurled connector 30 is then inserted within the appropriate opening 24 on the semi-circular extension 23 and is then tightened to insure support of the hip positioner and table extension at the preferred position.

An arrangement has herein been disclosed whereby a table extension carrying a surgical support device can be positionally arranged proximate an operating table within the operating table sterile field without requiring further sterilization procedures.

What is claimed is:

1. A table extension arrangement comprising:

a flat table extension supported by a pair of first and second support bars arranged beneath said flat table extension, said first support bar being fixedly attached to said table extension at one end thereof and said second support bar being arranged for moving along a bottom surface of said table extension;

a first support post connecting with said first support bar at one end and including a semi-circular central portion a plurality of openings on a perimeter thereon; and a second support post connecting with said semi-circular central portion at one end and connecting with said second support bar at an opposite end thereof;

whereby said second support bar and said table extension can be rotated in a clockwise and a counter-clockwise direction.

2. The table extension arrangement of claim 1 wherein said second support post includes means for removable connection with one of said perimeter openings for positioning said first and second support bars and said table extension in a horizontal plane.

3. The table extension arrangement of claim 2 wherein said second support post is removably connected with another of said perimeter openings for positioning said first support bar and said table extension below said horizontal plane.

4. The table extension arrangement of claim 1 including a limb positioner unit on a top surface of said table extension.

5. The table extension arrangement of claim 4 wherein said limb positioner unit is attached to said top surface via a suction cup.

6. The table extension arrangement of claim 1 including means for connecting said flat table extension onto a sterile operating table covered with a sterile drape.

7. The table extension arrangement of claim 6 wherein said flat table extension is attached onto a surgical table support post also covered with said sterile drape.

8. The table extension arrangement of claim 6 wherein said connecting means comprises a single lever clamp.

9. The table extension arrangement of claim 7 wherein said single lever clamp is removably attached to a connector plate arranged on said first support post.

10. The table extension arrangement of claim 4 wherein said limb positioner comprises a knee positioner.

11. The table extension arrangement of claim 4 wherein said limb positioner comprises a hip positioner.

* * * * *